US007299724B1

(12) United States Patent
Warheit

(10) Patent No.: US 7,299,724 B1
(45) Date of Patent: Nov. 27, 2007

(54) SELF-ADJUSTING GRIPPING TOOL

(76) Inventor: Matthew W. Warheit, 133 Dodds Rd., Butler, PA (US) 16002

( * ) Notice: Subject to any disclaimer, the term of this patent is extended or adjusted under 35 U.S.C. 154(b) by 0 days.

(21) Appl. No.: 11/657,175

(22) Filed: Jan. 24, 2007

(51) Int. Cl.
*B25B 7/04* (2006.01)
*B25B 7/12* (2006.01)

(52) U.S. Cl. ..... 81/409.5; 81/321; 81/413

(58) Field of Classification Search ..... 81/300, 81/313–315, 318–324, 329, 337, 338, 355–366, 81/405, 407–409, 409.5, 411, 413, 427
See application file for complete search history.

(56) References Cited

U.S. PATENT DOCUMENTS

| | | | | |
|---|---|---|---|---|
| 0,698,086 | A | 4/1902 | Wardwell et el. | |
| 1,048,298 | A * | 12/1912 | Daniels | 81/340 |
| 1,106,518 | A | 8/1914 | Matti | |
| 1,534,218 | A | 4/1925 | Jones | |
| 1,577,155 | A | 3/1926 | Anderson | |
| 1,651,216 | A | 11/1927 | McGill | |
| 1,739,715 | A | 12/1929 | Eckland | |
| 2,066,716 | A | 1/1937 | Cruickshank | |
| 2,156,529 | A * | 5/1939 | Day | 81/315 |
| 2,514,130 | A | 7/1950 | Jones | |
| 2,531,285 | A | 11/1950 | Manspeaker | |
| 2,557,296 | A | 6/1951 | Kress | |
| 2,587,263 | A | 2/1952 | Wortelmann | |
| 2,714,198 | A | 7/1955 | Schloetzer | |
| 3,005,368 | A | 10/1961 | Johnson | |
| 3,793,914 | A | 2/1974 | Helms | |
| 4,269,089 | A | 5/1981 | Hastings | |
| 4,271,732 | A | 6/1981 | Vaughan, Jr. | |
| 4,274,312 | A * | 6/1981 | Finn | 81/356 |
| 4,304,158 | A | 12/1981 | Brunosson et al. | |
| 4,438,669 | A | 3/1984 | Hastings | |
| 4,651,598 | A | 3/1987 | Warheit | |
| 4,662,252 | A | 5/1987 | Warheit | |
| 4,802,390 | A | 2/1989 | Warheit | |
| 4,819,521 | A | 4/1989 | Lang | |

(Continued)

FOREIGN PATENT DOCUMENTS

| | | |
|---|---|---|
| CH | 67463 | 2/1914 |

(Continued)

*Primary Examiner*—David B Thomas
(74) *Attorney, Agent, or Firm*—David C. Jenkins; Eckert Seamans Cherin & Mellott, LLC

(57) ABSTRACT

A tool includes a fixed operating lever and a pivoting operating lever that define handles that may be squeezed toward each other by a user to move the fixed and sliding jaws of the tool toward each other to grasp a workpiece. The fixed jaw is defined by the fixed lever. The sliding jaw is confined by the fixed operating lever. The position of the sliding jaw is limited by the operating levers, and its travel toward and away from the fixed jaw is defined by the operating levers. A biasing lever is operably connected to both operating levers. The biasing lever biases the jaws of the tool apart when there is no load applied to the tool and helps to transfer to the tool's jaws the force applied by a user to the tool's handles upon the engagement of a toothed pawl with a toothed surface of a slot within the fixed lever. The tool's jaws remain parallel to each other as they are moved toward or away from each other and while grasping a workpiece.

20 Claims, 12 Drawing Sheets

U.S. PATENT DOCUMENTS

| | | | | | |
|---|---|---|---|---|---|
| 4,893,530 | A | | 1/1990 | Warheit | |
| 4,957,020 | A | | 9/1990 | Monceret | |
| 5,060,543 | A | | 10/1991 | Warheit | |
| 5,134,908 | A | | 8/1992 | Fisher | |
| D343,779 | S | | 2/1994 | Imhoff | |
| 5,351,584 | A | | 10/1994 | Warheit | |
| D370,161 | S | | 5/1996 | Snyder | |
| 5,535,650 | A | | 7/1996 | McNatt | |
| 5,644,960 | A | * | 7/1997 | O'Brien | 81/363 |
| D392,167 | S | | 3/1998 | Cockrell et al. | |
| 5,740,690 | A | | 4/1998 | Holloway | |
| 5,845,551 | A | | 12/1998 | Putsch | |
| D415,939 | S | | 11/1999 | Staton | |
| D416,179 | S | | 11/1999 | Staton et al. | |
| 6,026,716 | A | | 2/2000 | Orlosky | |
| 6,116,124 | A | | 9/2000 | Ping | |
| 6,161,455 | A | * | 12/2000 | Ping | 81/358 |
| 6,237,449 | B1 | * | 5/2001 | Orlosky | 81/360 |
| D451,776 | S | | 12/2001 | Ping | |
| 6,327,943 | B1 | | 12/2001 | Wrigley et al. | |
| 6,508,149 | B1 | * | 1/2003 | Heggemann et al. | 81/320 |
| 7,100,479 | B2 | * | 9/2006 | Seber et al. | 81/357 |
| 7,216,570 | B2 | * | 5/2007 | Seber et al. | 81/357 |

FOREIGN PATENT DOCUMENTS

| | | | |
|---|---|---|---|
| DE | 958 459 | | 2/1957 |
| DE | 1016650 | | 9/1957 |
| DE | 969920 | | 7/1958 |
| DE | 1060330 | | 6/1959 |
| DE | 2031661 | | 1/1971 |
| EP | 421107 | A2 * | 4/1991 |
| FR | 1093672 | | 5/1955 |
| FR | 2456592 | | 12/1980 |

* cited by examiner

SELF-ADJUSTING GRIPPING TOOL

BACKGROUND OF THE INVENTION

The present invention relates to a hand tool that is used to grip a workpiece and, more particularly, to such a tool that is self-adjusting.

Self-adjusting pliers are used to grip a workpiece with one hand, without the need to pre-adjust the pliers to accommodate the size of the workpiece. That is, the pliers automatically adjust to the size of the workpiece so long as the workpiece can fit between the jaws of the pliers. A type of self-adjusting pliers can be found in U.S. Pat. Nos. 4,651,598 ("598"), 4,662,252 and 5,351,584. As is described at column 1, lines 24 through 43 of 598, this type of pliers has first and second operating levers that define first and second jaws, respectively, which form one end of each lever. The remaining end of each lever defines a handle section. The handle sections can be manipulated with one hand to grip a workpiece of any size that fits between the jaws. One lever defines an elongated channel or slot having parallel opposed and interconnected side walls. One side wall of the channel defines a raceway and the other side wall defines a series of teeth. A pawl member is pivotally connected to the other lever and is confined within the elongated channel by a fastener that secures the levers together. A spring biased control arm interconnects the two levers intermediate their ends and continually urges one side of the pawl into contact with the raceway, which spaces the jaws and handle sections away from each other. The jaws move toward one another when the handle sections are squeezed together. When a workpiece is positioned between the jaws and the handle sections are squeezed together, the jaws will engage the workpiece and begin applying a limited force to the workpiece between the jaws. As the handle sections are squeezed together further, the control arm will move the pawl out of engagement with the raceway and, by a cam action, move it across the slot into engagement with the toothed surface of the slot, where the pawl is locked between two adjacent teeth of the toothed side wall of the slot. In this engaged position, the full force used to squeeze the handle sections together is effectively transferred to the jaws and amplified by simple leverage via the handle sections to allow the tool to grip the workpiece. Accordingly, the tool need not be adjusted to grip objects of different sizes.

As the user squeezes the handle sections of this type of tool together, the jaws pivot toward one another in "plier fashion." That is, the movement of the jaws mimics the movement of the jaws of an ordinary pair of pliers in that the gripping faces of the jaws do not remain parallel to each other as they pivot. While this type of movement of the jaws is acceptable in situations where pliers are typically used, it is limiting in applications (for example, grasping flat or hex-shaped workpieces) in which the gripping faces of the jaws should remain parallel to each other. Spanners are typically used in these applications since the gripping faces of the jaws of a spanner are always parallel to each other as the jaws are moved toward each other to grasp the workpiece.

However, ordinary adjustable spanners are not self-adjusting. The jaws must be manually adjusted prior to gripping the workpiece to accommodate workpieces of different sizes. Typically, this adjustment is made by turning a threaded wheel that adjusts the distance between the gripping surfaces of the spanner, which makes conventional spanners somewhat awkward to use. More importantly, however, and unlike pliers, the jaws of a spanner cannot apply a levered force against a workpiece located between its jaws. Also, conventional adjustable spanners have fixed operating positions that require a clearance between the jaws of the spanner and the workpiece. In other words, the engagement between the jaws of the spanner and the workpiece is not tight. For example, the jaws of a spanner engage the corners of the head of a hex bolt, rather than the sides, which increases the possibility that the jaws will round off the corners of the hex bolt head under high torque loads.

Therefore, there is a need for a self-adjusting gripping tool that can apply a levered force against a workpiece that is located between its jaws, and that maintains a parallel relationship between the gripping faces of the jaws of the tool as the tool is operated.

SUMMARY OF THE INVENTION

The present invention provides a hand tool that may be used to apply a compound leveraged force to a workpiece that is located between its gripping surfaces to secure the workpiece. The gripping surfaces remain substantially parallel to each other as they are moved during operation of the tool. The position of the gripping surfaces is controlled by hand operated levers. The gripping surfaces are operatively associated with the levers, which can be manipulated to move the gripping surfaces through a predetermined range of motion. The levers not only position the gripping surfaces, but also transfer to the workpiece through the gripping surfaces the force that is applied by the user to the levers. The workpiece can be any object of any size or shape that fits between the gripping surfaces. Because the gripping surfaces remain parallel to each other as the levers are manipulated, the tool is particularly useful in applications for which pliers are not well-suited, and for which spanners are typically used. Note that the gripping surfaces are sometimes also referred to herein as workpiece bearing surfaces.

The tool is self-adjusting in that the mechanism variably locates the fulcrum of the lever based on a simple squeezing of the handle sections by the operator. That is, the position of the jaws on which the gripping surfaces are formed need not be adjusted prior to using the tool to grip workpieces of different sizes. Regardless of the size of the workpiece, only one hand is needed both to position the workpiece between the gripping surfaces and to manipulate the levers until the gripping surfaces engage the workpiece. The gripping surfaces of the tool can be smooth or toothed, or they can define any other desired configuration. Because the gripping surfaces move parallel to each other as the tool is operated, the tool can grip hex fasteners using smooth gripping surfaces, in the manner of a "Crescent" wrench.

A preferred embodiment of the present invention is a tool that includes two levers: one a relatively fixed lever that defines a handle section on one end and a fixed jaw that defines a gripping surface on the other end, and the other a relatively pivoting lever operatively connected to the fixed lever. This preferred embodiment also includes a sliding jaw element slidably confined by the fixed lever and operably connected to the pivoting lever, a biasing assembly operably connected to the fixed and pivoting levers, and a pawl which operates within a slot in the fixed lever. The handle sections operate the levers to move the jaws of the tool together to grip the workpiece. When the user is holding the tool in a position to operate it, but not exerting any substantial force against the handle sections, the handle sections and jaws are biased in a fully open position, in which the handle sections have reached their limit of travel away from each other.

When the user's hand squeezes the handle sections toward each other, the levers rotate about a pivot on the biasing lever, and the sliding jaw approaches the fixed jaw to engage a workpiece positioned between them. After the workpiece is engaged by the jaws, the tool shifts the location of its active fulcrum to the connection between the pivoting lever and the pawl when the pawl teeth engage the teeth of a slot on the fixed lever. The levers react with this newly active fulcrum to compound the force applied by the user's hand against the workpiece through the tool's jaws. Consequently, the sliding jaw and the pivoting lever define a compound leverage mechanism, and the tool may deliver a force through its jaws to the workpiece that is of a magnitude that is approximately three times the force delivered by simple pivoted pliers designs of similar size. Other embodiments of the present invention are capable of transmitting other levels of leverage.

It is to be understood that in the preferred embodiments, the biasing lever can have any configuration that allows it to perform at least three interrelated functions with respect to the fixed lever and the pivoting lever. First, when a user is not applying force to the hand operated levers, the biasing lever maintains the pawl in a position in which the teeth of the pawl are not engaged with the teeth in the slot of the fixed lever. Second, the biasing lever urges the handle sections away from each other to move the tool into the open position. Third, during the time that the teeth of the pawl are not engaged with the teeth in the slot of the fixed lever, the biasing lever provides at its end that is operably connected to the pivoting lever a temporarily active fulcrum for the pivoting lever to rotate about.

It should be understood that this invention is not limited to the embodiments disclosed herein, but is intended to cover all modifications that are within the spirit and scope of the invention, as defined by the appended claims.

BRIEF DESCRIPTION OF THE DRAWINGS

The following description of the preferred embodiments may be understood better if reference is made to the appended drawings, in which.

DETAILED DESCRIPTION OF THE INVENTION

Figure 1:
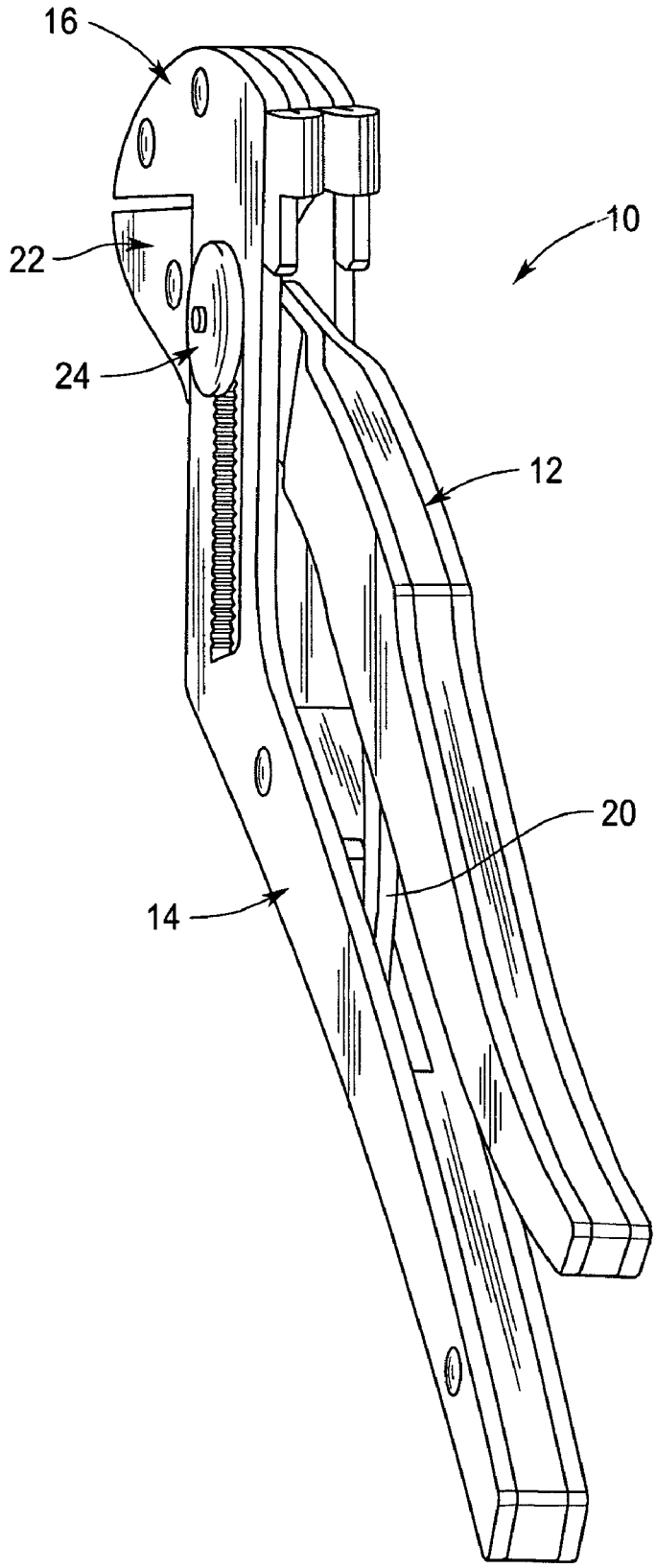
FIG. 1 is a perspective view of a first embodiment of the present invention that has a laminated construction.

It is to be understood that the Figures and descriptions of the preferred embodiments of the present invention have been simplified to illustrate elements that are relevant for a clear understanding of the present invention, while eliminating, for purposes of clarity, other elements. Those of ordinary skill in the art will recognize that other elements may be desirable in order to implement the present invention. However, because such elements are well known in the art, and because they do not facilitate a better understanding of the present invention, a discussion of such elements is not provided herein.

In the present Detailed Description of the Invention, the preferred embodiments of the invention are illustrated as variations of a self-adjusting tool having a particular configuration. However, persons skilled in the art will recognize that the present invention may take on other configurations and will be able to construct those configurations based upon the description presented herein. To the extent that the described configuration implies the size and shape of the workpiece that is able to be gripped by tools of the present invention, it should be understood that other embodiments of the present invention may be capable of gripping workpieces of other sizes and shapes.

Also, the preferred embodiments of the present invention are described and/or illustrated herein in a normal operating position, and terms such as upper, lower, front, back, horizontal, proximal, distal, and the like, may be used with reference to the normal operating position of the preferred embodiments. It will be understood, however, that the apparatus of the invention may be manufactured, stored, transported, used, and sold in orientations other than those described and/or illustrated herein.

Other than in the operating examples, or where otherwise indicated, any and all numbers expressing dimensions, angular orientations and so forth used in the specification and claims are to be understood as being modified in all instances by the term "about." Accordingly, unless indicated to the contrary, the numerical parameters set forth in the following specification and attached claims are approximations that may vary depending upon the use to which the invention is put. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include all sub-ranges between and including the recited minimum value of 1 and the recited maximum value of 10, that is, having a minimum value equal to or greater than 1 and a maximum value equal to or less than 10.

The drawings show some of the presently preferred embodiments of the present invention. Each of the preferred embodiments illustrated shares certain structural similarities and common methods of operation, which are explained below as relating to each of the described embodiments. This explanation is followed by a separate discussion of preferred embodiments of the present invention.

Each tool shown in the drawings is a self-adjusting tool that automatically adjusts the location of the levers' active fulcrum and allows a user to grip a workpiece between a pair of jaws while using a limited range of input by the user's hand. Consequently, the user's hand makes a very similar movement regardless of the size of the workpiece. Each tool includes a pair of levers. With respect to the relative motion of these levers to one another, one of these levers can be considered to be a fixed lever and the other to be a pivoting lever. The tools also include a biasing lever and a toothed pawl assembly, both of which are part of the self-adjusting mechanism of the tool. In describing the tool's operation, the fixed lever can be viewed as the static component of the tool with the movement of the pivoting and biasing levers and the sliding jaw occurring in relation to the fixed lever. Each of the fixed and pivoting levers defines a handle section. The user can squeeze the handle sections of the fixed and pivoting levers toward each other with one hand to cause the sliding jaw to move toward the fixed jaw of the fixed lever.

It is to be understood that any or all of the fixed lever, the pivoting lever, the biasing lever, the fixed jaw, and the sliding jaw can have any suitable configuration and be constructed of any suitable material. For example, they can be formed as solid pieces, e.g., as forgings, stampings, or castings, or they can be of a laminated construction. In the description presented below, only laminated construction versions of the fixed lever and the pivoting lever are described, while both laminated construction and solid piece versions of the biasing lever, the fixed jaw, and the sliding jaw are described. It is to be understood that in the preferred embodiments, the biasing lever can have any configuration and be made of any material that allows it to perform at least three interrelated functions with respect to the fixed lever and the pivoting lever. First, when a user is not applying force to the hand operated levers, the biasing lever maintains the pawl in a position in which the teeth of the pawl are not engaged with the teeth in the slot of the fixed lever. Second, the biasing lever urges the handle sections away from each other to move the tool into the open position. Third, during the time that the teeth of the pawl are not engaged with the teeth in the slot of the fixed lever, the biasing lever provides at its end that is operably connected to the pivoting lever a temporarily active fulcrum for the pivoting lever to rotate about.

The pivoting lever has three sections: a nose at one end that engages a slot defined by the sliding jaw, an intermediate section that defines a hole by which a pawl assembly may be connected thereto with a pin, and a handle section that is to be engaged by the user's hand during use of the tool.

The fixed lever includes a fixed jaw, an intermediate section that defines a toothed slot for the pawl and bearing surfaces for the sliding jaw, and a handle section that is to be engaged by the user's hand during use of the tool. The sliding jaw can slide along the bearing surfaces of the fixed lever toward and away from the fixed jaw during operation of the tool.

The biasing lever is operably connected to both the fixed and pivoting levers.

The tool is considered to be under load when a user is squeezing the handle sections toward one another, the teeth of the pawl are engaged with teeth of the toothed slot of the fixed lever, and a workpiece is being gripped by the jaws of the tool or the jaws have come together, if a workpiece is not present between the jaws. Otherwise, the tool is considered not to be under load. The tool is in the rest position when the handle sections are not being squeezed by a user, the teeth of the pawl are out of engagement with the toothed surface defined by the slot of the fixed lever, the smooth surface of the pawl is in contact with the smooth surface of the toothed slot, and the forces produced by the biasing lever have urged the handle sections apart to their maximum limit of travel (see FIG. 3).

The fixed lever includes a fixed jaw element that can be provided with various forms of contact or gripping surfaces to engage various types of workpieces. Preferably, the fixed jaw is positioned at roughly a right angle to the toothed slot of the intermediate section of the fixed lever and the fixed lever has a generally "Z" shape with the handle section being significantly longer than its other two sections. The handle section may define a curvature that aids in squeezing the levers together.

Figure 13:
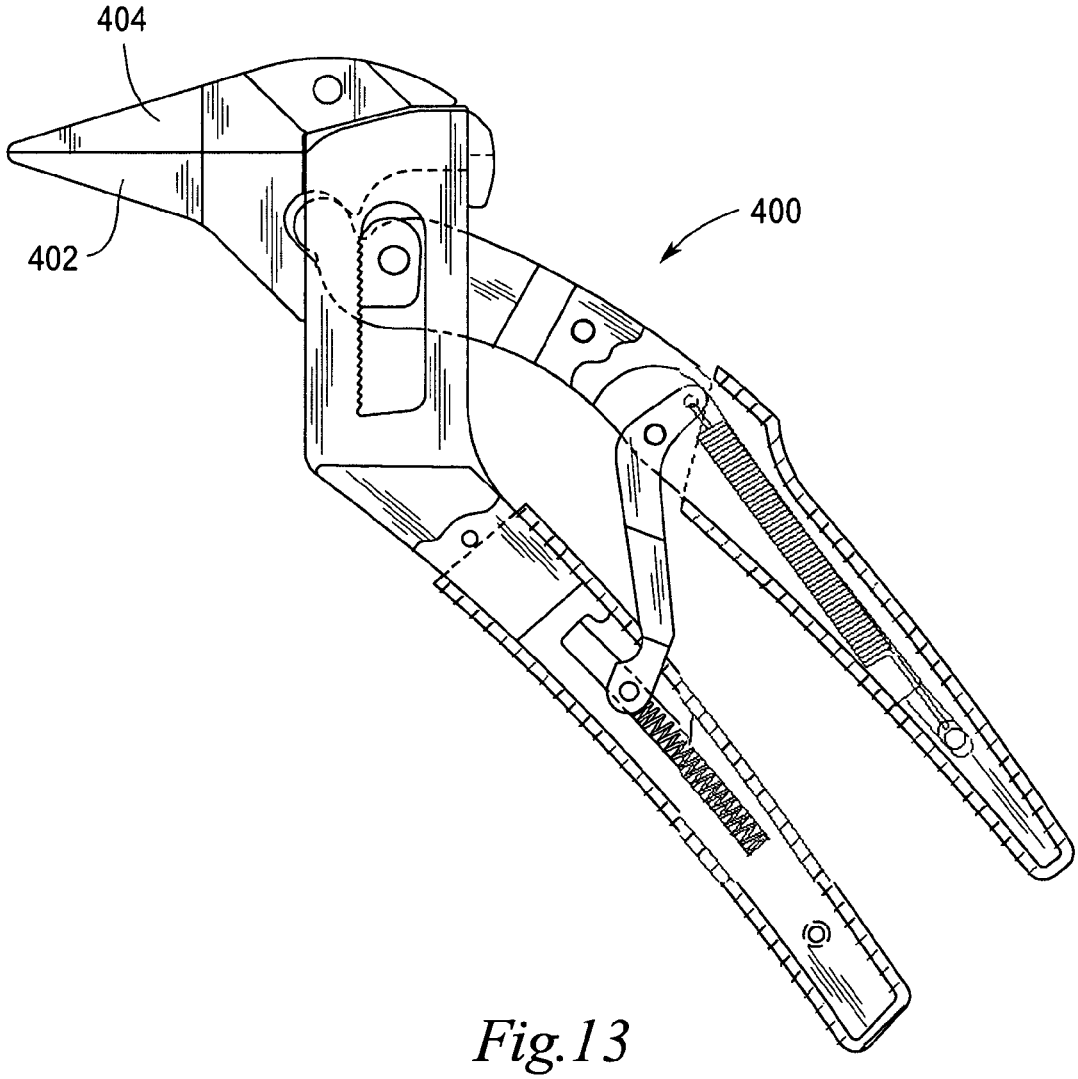
FIG. 13 is another embodiment of the present invention, having the outer side wall of the handle section cut away to reveal internal structure of the levers and elongated solid walls, shown in the fully closed position.
Figure 14:
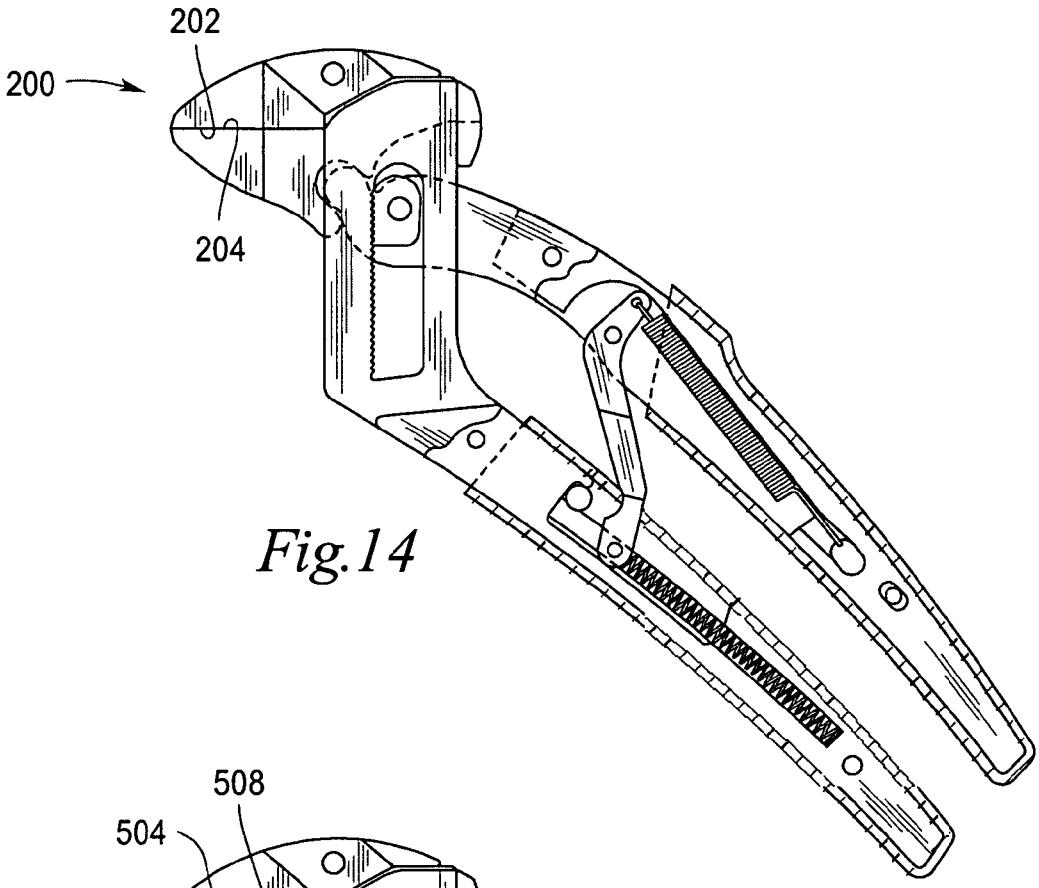
FIG. 14 is a side elevation view of another embodiment of the present invention with conventional flat spanner jaws, having the outer side wall of the handle section cut away to reveal internal structure of the levers, shown in the fully closed position.
Figure 15:
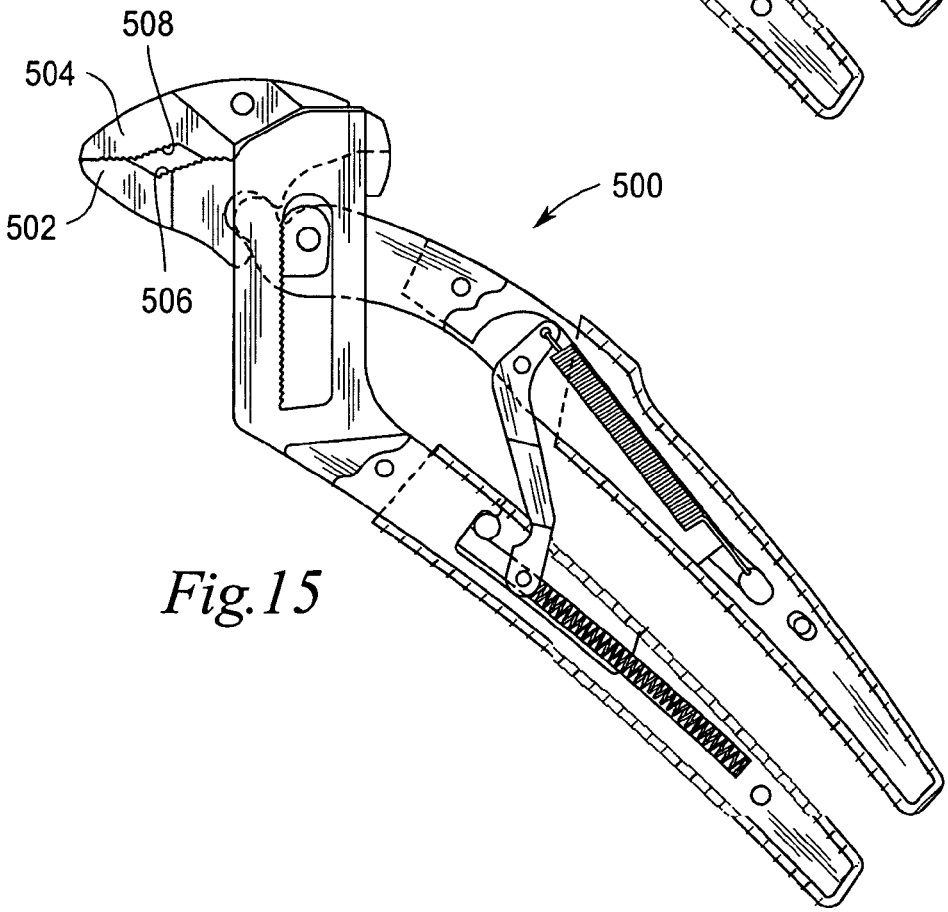
FIG. 15 is a side elevation view of another embodiment of the present invention having the outer side wall of the handle section cut away to reveal internal structure of the levers, shown in the fully closed position, the jaws being configured with a known arrangement to promote self-engagement once loaded.
Figure 16:
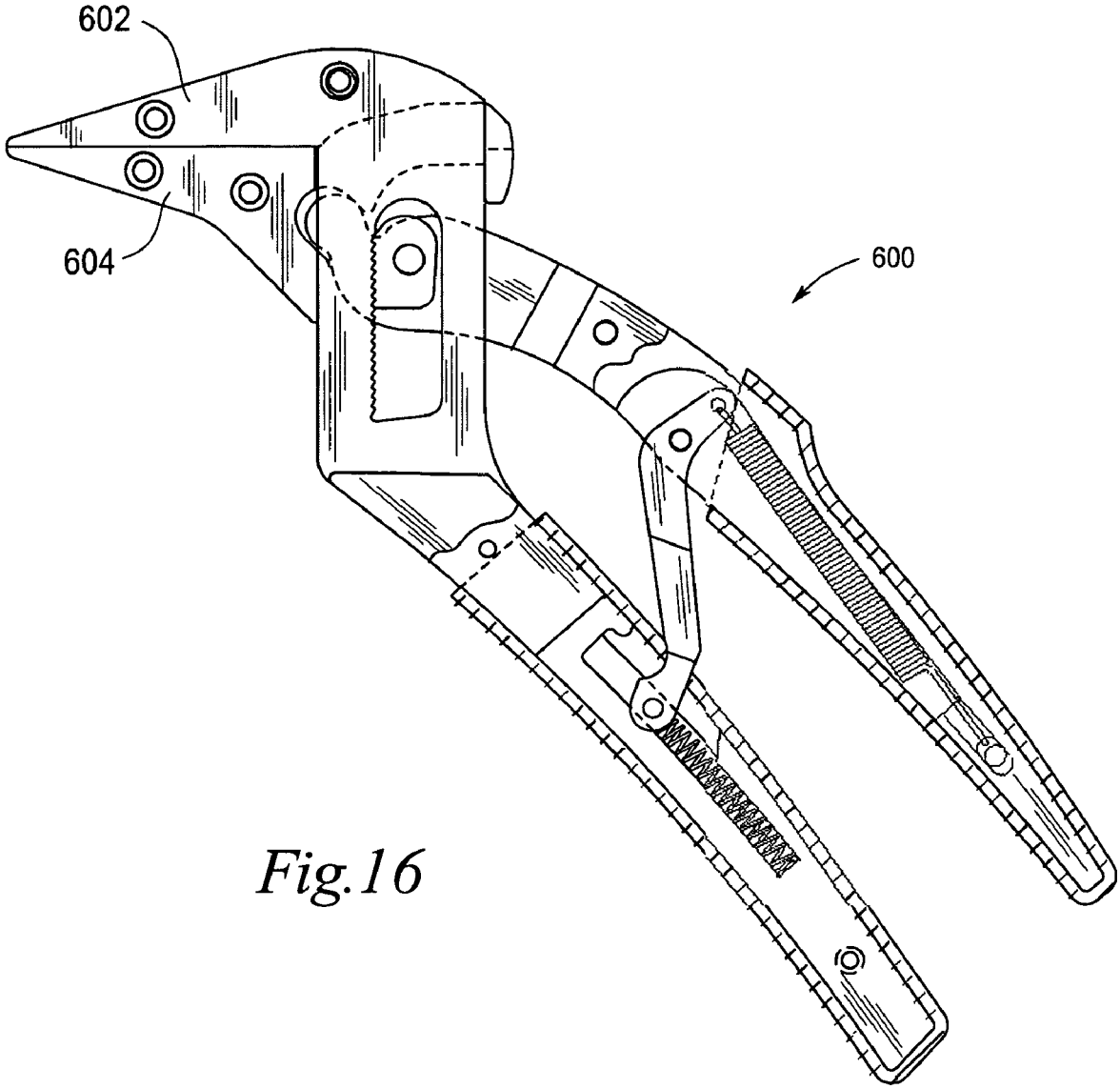
FIG. 16 is a side elevation view of another embodiment of the present invention having elongated laminated jaws, having the outer side wall of the handle sections cut away to reveal the internal structure of the levers, shown in the fully closed position.

The jaws can be of laminated or solid construction. The jaws of the preferred embodiments of the present invention shown in FIGS. 1 and 16 are of laminate construction. Each of those tools includes a fixed lever that defines a flat plate on which additional laminate parts are fastened using rivets to build a laminated jaw structure. The fixed jaw of each of the preferred embodiments shown in FIGS. 13 through 15 is solid in that it is formed from a single piece of metal having grooves that are mounted to the tongues of the intermediate section of the fixed lever between two laminated segments of the fixed lever. The grooves and the tongues of the laminated lever segments are shaped to allow these components to interlock with each other. This interlocking arrangement, along with a rivet that passes through the laminated segments and the jaw body, holds the jaw in position. Similarly, the sliding jaw in these embodiments is of a solid, rather than a laminated, construction. In both cases, the gripping surfaces of the jaws can be of a variety of styles to suit specific job requirements and the shape of the workpiece, The intermediate section of the fixed lever has a toothed slot which acts in conjunction with a pawl. The toothed slot defines a toothed edge on the side that is nearest the jaws of the tool, and a smooth edge on the opposite side of the toothed slot. The toothed slot establishes the limits of travel for the pawl and has a width that is sufficient to allow the pawl to travel freely within it when the pawl is moving along the smooth edge of the toothed slot.

The biasing lever can assume any suitable configuration and can be constructed of any suitable material. For example, it can be configured to be a single-piece lever that is attached to the pivoting and fixed levers by fixed and sliding pins to provide a spring loaded sliding ramp (see FIG. 3), or it can be configured as a knee-action solid biasing lever (see FIG. 17).

The sliding jaw broadly defines three elements: a gripping surface, parallel bearing surfaces that prevent movement of the sliding jaw in two orthogonal planes and allow linear travel in the remaining orthogonal plane and, finally, an inclined receiving slot that provides for the engagement of the pivoting lever with the sliding jaw and the transfer to the workpiece of forces applied to the handle sections of the tool by the user.

The sliding jaw is oriented in the same plane as that of the fixed jaw of the fixed lever and its gripping surface is substantially parallel to or in mirror opposition to the gripping surface of the fixed jaw. Being guided by the complementary parallel bearing surfaces of the fixed lever's intermediate section and the sliding jaw, the movement of the sliding jaw is along a path that is parallel to the bearing surfaces and perpendicular to the gripping surfaces of the jaws. Linear travel of the sliding jaw is limited by the presence of the fixed jaw when the tool is in the closed position and contact by the pawl with the far end of the toothed slot when the tool is in the open position.

The sliding jaw has a receiving slot for receiving the nose end of the pivoting lever. The longitudinal axis of the receiving slot is angled upwardly toward the gripping surface of the sliding jaw. Angles of about 30° to less than 90° relative to the center line of travel of the sliding jaw are preferable, with 45° being most preferred.

Without intending to be bound, the inventor believes that the receiving slot produces three important functions in the self adjusting mechanism of the present invention. First, the angle of the longitudinal axis of the receiving slot influences the production of a force that overcomes the biasing force that tends to urge the pawl toward the smooth side of the toothed slot. Second, the receiving slot provides compensation for the rotation of the pivoting lever by allowing the pawl to move toward the gripping surface of the sliding jaw as the pawl traverses towards the teeth of the toothed slot, thereby generally improving the relative positions of the handle sections for the operator. Third, the toothed slot permits the force applied by the operator to the handle sections of the tool to go more directly into the root of the teeth of the toothed slot so that more of that force is applied normal to the teeth of the toothed slot and that less is applied in a direction that is parallel to the teeth. This ensures better engagement between the teeth of the pawl and the teeth of the toothed slot. It also reduces the likelihood that the force applied by the operator to the handle sections of the tool will shear teeth off the teeth of the toothed slot. Consequently, the teeth need not be as strong, or large they otherwise would need to be, and more teeth for finer adjustment of the position of the jaws can be provided in the same space. This increases the precision of positioning the pawl, and, thus, of positioning the jaws. In contrast, the pivoting cam action of prior art self-adjusting pliers may result in the engagement of only one corner of the pawl with the teeth of the corresponding toothed slot. In such prior art pliers, a significant tension load may be placed on the web of the pawl between the pin hole and the pawl's smooth side, creating a potential for a failure of the pawl web. The preferred embodiments of the present invention allow more pawl teeth to be engaged and guide the forces more directly across the pawl web into the root of the teeth. The inventor believes that these features improve the strength of the engagement of the teeth and increase the load that can be transmitted through them to the jaws and the workpiece.

When the tool first comes under load, jaw movement stops, either because the gripping surfaces of the jaws contact a workpiece or, if there is no workpiece between the jaws, because the gripping surfaces come into contact with each other. At this point, the nose of the pivoting lever begins moving within the receiving slot toward the gripping surfaces of the jaws as the user continues to squeeze the handle sections toward one another. This movement draws the pawl across the toothed slot and results in the engagement of the pawl teeth with those of the toothed slot. Once this engagement occurs, the location of the active fulcrum of the tool is transferred from the connection between the biasing lever and the pivoting lever to the connection between the pawl and the pivoting lever. As the user continues to squeeze the handle sections together, the force exerted against the handle sections by the user may be multiplied through the active fulcrum and applied to the workpiece that is between the tool's jaws. Without the receiving slot, the movement of the pivoting lever from the start of the application of force to the handle sections is one of pure rotation about the contact point between the nose of the pivoting lever and the sliding jaw. Such pure rotation would cause the self-adjusting mechanism of the tool to perform inconsistently because the full extent of the available rotation of the pivoting lever would sometimes be used up before the pawl teeth engaged those of the toothed slot. The inventor believes, without intending to be bound, that providing performance consistency is one of the most important problems solved by the present invention.

The nose of the pivoting lever defines a contact surface that is of a size and shape that permits the nose to fit within the receiving slot in the sliding jaw. Preferably, the nose defines an arcuate contact surface and fits closely within the receiving slot. More preferably, this arcuate contact surface is of a partially circular design. Such a circular design allows rotation of the pivoting lever relative to the sliding jaw while maintaining close control of the closing and opening linear movement of the sliding jaw. It is preferred that the fit between the nose and the receiving slot be such that the forward travel of the nose within the receiving slot is not arrested prior to the full engagement of the pawl teeth with the teeth of the toothed slot. Thus, so long as such arresting is avoided, it may be advantageous to design the tip end of the nose or the closed end of the receiving slot to have non-circular shapes thereby providing additional material and strength to be designed in the sliding jaw structure. The inventor believes, without intending to be bound, that the ability to maintain close and consistent clearances between the nose and the receiving slot allows the sliding jaw and the pivoting lever to move synchronously, with little or no play or hesitation when reversing the direction of travel of the sliding jaw and when the tool is held in various working positions against gravitational loads.

The intermediate section of the pivoting lever functions as a load beam. In some preferred embodiments of the present invention, this intermediate section defines a hole near the centerline of its broad side. A pin may be inserted into this hole to act as both a locator and a load support for the pawl, as well as a point around which the pawl can rotate within the limits imposed by the toothed slot of the fixed lever. In some embodiments of the present invention, the pawl is connected to a cantilevered pin which is rigidly fastened to the pivoting lever. The pin can be double supported, as it is in some embodiments of the present invention which use a laminated design. In such laminated design embodiments, one or more laminate pieces make up the pivoting lever, and one or more laminate pieces make up the fixed lever. A toothed slot may be provided in one or more of the laminate pieces of the fixed lever and a corresponding pawl is preferably provided for each toothed slot. When multiple pawls are used, they may be connected by a common pin to one or more of the pivoting lever laminate pieces.

In preferred embodiments of the present invention, the handle section of the pivoting lever adjoins the intermediate section at a slight angle. The principal function of the handle section is to receive force from the user's hand, typically via the palm of the user's hand. The upper end of the biasing lever is operably connected to this handle section.

As already mentioned, the pawl has a smooth side and a toothed side. These smooth and toothed sides may be parallel or non-parallel to one another. Likewise, the smooth and toothed sides of the toothed slot of the fixed lever may be parallel or non-parallel to one another. Preferably, the teeth of the pawl are of the same shape and pitch as those of the toothed slot of the fixed lever with which they are to engage. The smooth side of the pawl permits free movement of the pawl along the smooth side of the toothed slot. Preferably, the travel of the pawl along the smooth surface of the toothed slot is unrestricted. A hole may be located in the broad face of the pawl, preferably at its center, through which a pin may be inserted to pivotally connect the pawl to the intermediate section of the pivoting lever. When a user squeezes the handle sections together to bring the tool under load against a workpiece, the pawl moves across the toothed slot laterally from the smooth side of the toothed slot to engage the teeth of the toothed slot.

The inventor believes, without intending to be bound, that in the preferred embodiments of the present invention the biasing lever, in conjunction with operably connected springs, performs three interrelated functions with respect to the fixed lever and the pivoting lever. First, when a user is not applying force to the handle sections of the tool, the biasing lever urges the pawl against the smooth side of the toothed slot of the fixed lever. Second, the biasing lever urges the handle section of the pivoting lever away from that of the fixed lever to move the tool into the open position. Third, during the time that the pawl is sliding freely as the user squeezes the handle sections toward each other, the biasing lever provides at its end that is functionally connected to the pivoting lever a temporarily active fulcrum for the pivoting lever to rotate about. When the tool encounters a workpiece between its jaws, the pawl moves away from the smooth side to the toothed side of the toothed slot, and the teeth of the pawl lockingly engage the teeth of the toothed slot. As a result of this engagement, the active fulcrum of the tool shifts to the operable connection between the pawl and the pivoting lever. Further application of force to the tool handle sections causes the pivoting lever to rotate about this newly active fulcrum and the applied forces to be transmitted through the gripping surfaces of the jaws to the workpiece. The jaws are substantially parallel to one another during this force transmission to the workpiece.

Numerous methods exist to accomplish this temporary fulcrum biasing action. One conventional biasing design for prior art self-adjusting pliers, which is employed in some embodiments of the present invention, requires pivoting the biasing lever near the jaw end of the pivoting handle section forward of the contact area with the user's hand. In this design, a spring attached to a first end of the pivoting lever applies a load to the biasing lever to urge the second end of the biasing lever toward the jaw end of the pivoting lever. This second end is retained within a groove in the handle section of the fixed lever. A second spring optionally may be provided within this groove to produce a force that will resist sliding of the biasing lever second end until a predetermined level of closing load is applied to the tool handle sections after the pawl teeth have lockingly engaged the teeth of the toothed slot.

Other conventional biasing lever designs of prior art self-adjusting pliers may be used with embodiments of the present invention. Some such designs employ a two part biasing lever that is referred to in the art as a knee-action biasing lever. A knee-action biasing lever has a spring loaded joint connecting its two parts at about the center of the lever. A knee-action biasing lever collapses as the tool handle sections are moved toward one another after the engagement of the pawl teeth with those of the toothed slot. This collapse permits the pivoting lever to close toward the fixed lever. One end of the knee-action biasing lever may be rotatably connected to the fixed lever and its other end rotatably connected to the pivoting lever.

Separate discussions for individual preferred embodiments of the present invention are presented below.

Figure 2:
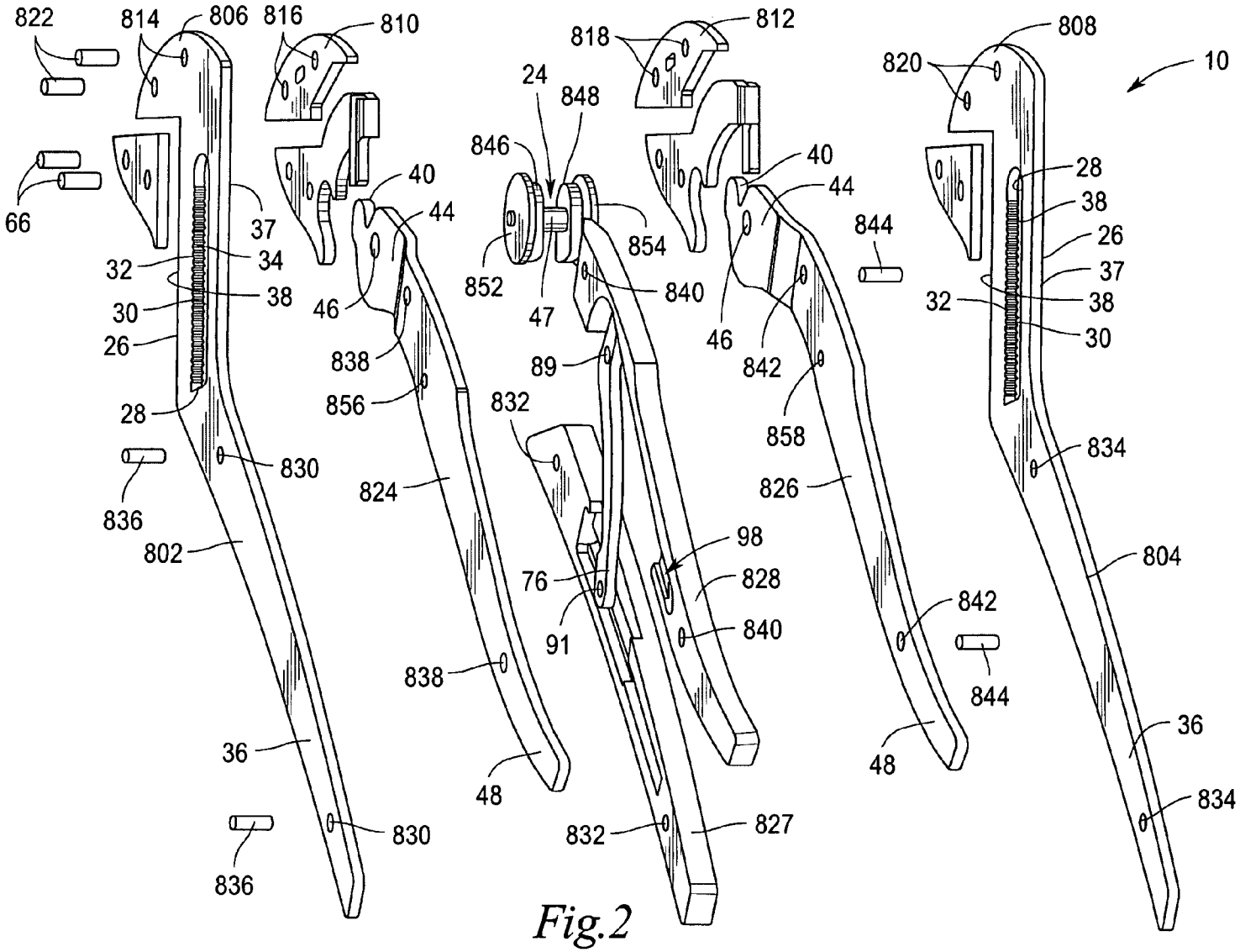
FIG. 2 is an exploded view of the tool shown in FIG. 1, except that the spring elements present in the tool are omitted from this view.
Figure 3:
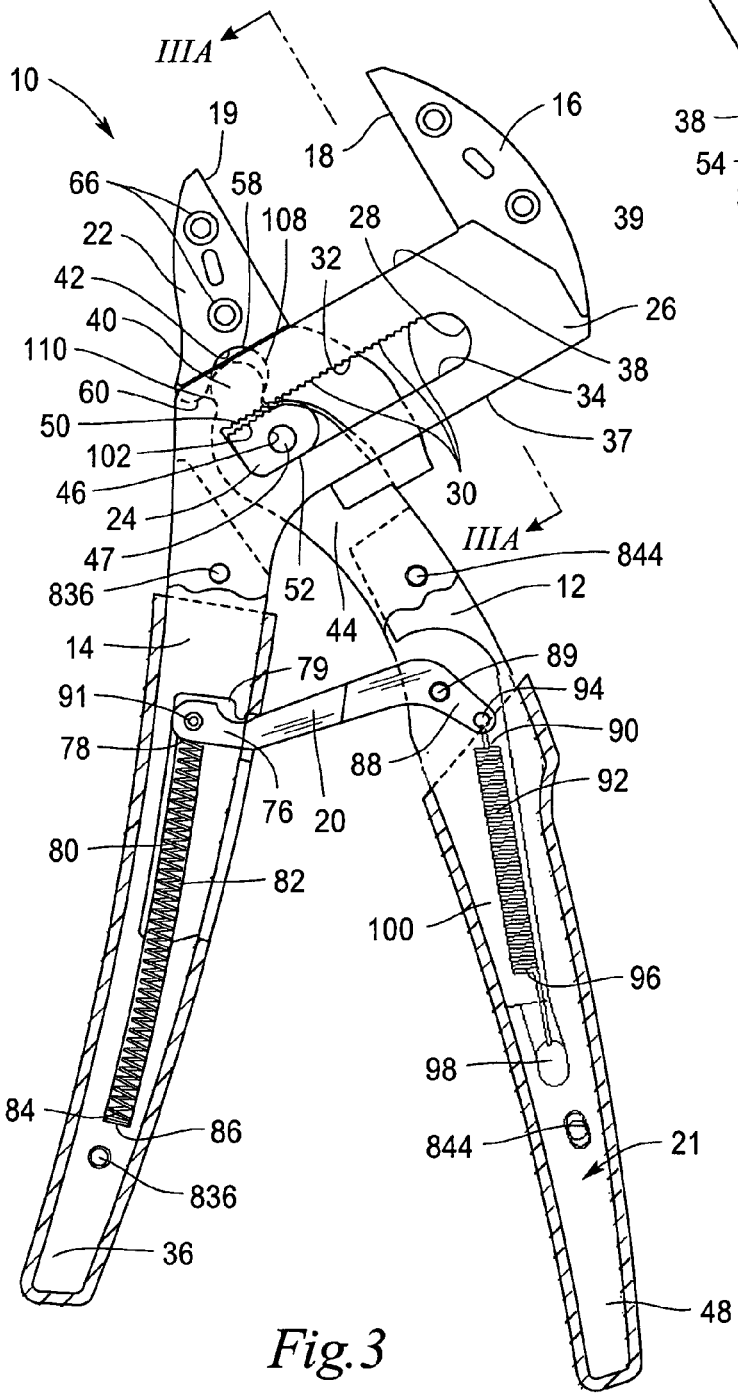
FIG. 3 is side elevation view of the tool shown in FIG. 1.

Accordingly, FIGS. 1 through 5 show a self-adjusting tool 10 of a "laminated" construction. That is, tool 10 has jaws and levers that are formed of flat pieces of a uniform thickness that have been secured together by a suitable means, such as rivets. As will be recognized by those of ordinary skill in the art, the configuration of the jaws and gripping surfaces of tool 10 make tool 10 particularly useful for gripping smooth hex fasteners. Generally, tool 10 includes two operating levers, lever 12, which corresponds to the pivoting lever and lever 14, which corresponds to the fixed lever in the foregoing discussions. Lever 14 defines a fixed jaw 16 with a smooth gripping surface 18, which is used to engage one side of the workpiece. Tool 10 also includes a biasing lever 20, a sliding jaw 22, which defines a smooth gripping surface 19, and a pawl assembly 24. The levers 12 and 14 transfer to the workpiece located between jaws 16 and 22 the force that the user applies by hand to handle sections 48 and 36 of levers 12 and 14, respectively. The biasing lever assembly 20 interacts with the two levers 12 and 14 to position tool 10 in its open position (as shown in FIG. 3) and to position pawl assembly 24 against the smooth edge 34 of slot 28. Slot 28 corresponds to the toothed slot in the foregoing discussions.

The first operating lever, lever 14, is formed from identical lever pieces 802 and 804, and by pieces 810, 812, and 827. When they are mounted together, pieces 810, 812, and 827 are sandwiched between pieces 802 and 804. Pieces 802, 804 and 827 are riveted together through holes 830 formed in piece 802, holes 832 formed in piece 827 and holes 834 formed in piece 804 using rivets 836. Each lever piece 802 and 804 defines an intermediate section 26 that includes an elongated slot 28 with teeth 30 along its forward edge 32. Each slot 28 also defines a smooth edge 34 that opposes toothed edge 32. Each piece 802 and 804 also defines a handle section 36 by which the user's hand engages lever 14. Each intermediate section 26 has a uniform cross section that permits it to function as a bearing surface that guides the movement of the sliding jaw member 22. Specifically, the intermediate section 26 of each piece 802 and 804 defines a pair of parallel bearing surfaces 37 and 38, which are parallel to each other, along the entire length of intermediate section 26. Section 26 of piece 802 also defines a pair of bearing surfaces 39 and 41. Section 26 of piece 804 also defines a pair of bearing surfaces 43 and 49. Sliding jaw 22 is movably confined by lever 14 between pieces 802 and 804 so as to be able to slide along bearing surfaces 37 and 38, and 39, 41, 43 and 49. Accordingly, surfaces 37, 38, and 39, 41, 43 and 49 form bearing surfaces for jaw 22. The consistent rectangular cross section of intermediate sections 26, together with the bearing surfaces formed by surfaces 37, 38, 39, 41, 43 and 49, prevents lateral movement or axial rotation of jaw 22 with respect to sections 26 and, consequently, constrains the travel of jaw 22 to a linear path toward and away from jaw 16.

Jaw 16 of lever 14 is a fixed jaw and is formed from sections 806 and 808 defined by pieces 802 and 804, respectively, and by pieces 810 and 812. Pieces 806, 808, 810, and 812 are riveted together through holes 814 formed in piece 806, holes 816 formed in piece 810, holes 818 formed in piece 812, and holes 820 formed in piece 808 using rivets 822. Accordingly, pieces 810 and 812 are sandwiched between pieces 806 and 808 to form jaw 16.

The second operating lever, lever 12, is formed from laminate pieces 824, 826, and 828. When they are mounted together, piece 828 is sandwiched between pieces 824 and 826. Pieces 824, 826, and 828 are riveted together through holes 838 formed in piece 824, holes 840 formed in piece 828, and holes 842 formed in piece 826 with rivets 844. Each piece 824 and 826 defines a circular end 40, which corresponds to the nose end in the foregoing discussions, that engages an angled slot 42, which corresponds to the receiving slot in the foregoing discussions, defined by jaw 22, an intermediate section 44 that defines a hole 46 that is used to operably connect the pawl assembly 24 to the lever 12, and a handle section 48 that engages the user's palm during use of tool 10. The biasing lever 20 operably connects the two levers 12 and 14 forward of their handle sections 48 and 36, respectively. Spring 92, which is attached to biasing lever 20, biases the levers 12 and 14 to the open position by providing a force that rotates circular end 40 of lever 12 away from the workpiece.

Pawl assembly 24 is formed from pawls 846 and 848, shaft 47, which connects pawls 846 and 848 together, and pawl covers 852 and 854. Pawls 846 and 848 are suitably connected to each end of shaft 47. Pawl assembly 24 is rotatably connected to lever 12 by shaft 47 being inserted through holes 46 of lever 12. There is sufficient clearance between shaft 47 and the edges of holes 46 to permit shaft 47 to rotate within holes 46. Each of pawls 846 and 848 defines a toothed edge 50 and a smooth edge 52. Pawl assembly 24 is so positioned that toothed edge 50 of each pawl 846 and 848 confronts the teeth of edge 32 of a slot 28, and smooth edge 52 of each pawl 846 and 848 confronts smooth edge 34 of a slot 28. Each pawl 846 and 848 is oriented in the same plane as the slots 28 and is adapted to alternately engage the teeth 30 on edge 32 of a slot 28 when tool 10 is under load or slide freely on edge 52 against smooth edge 34 of slot 28 when the tool 10 is not under load. A pawl cover 852 is suitably attached to one end of shaft 47, and another pawl cover 854 is suitably attached to the opposite end of shaft 47. Together, covers 852 and 854 serve to retain pawl assembly 24 between lever piece 802 and lever piece 804, and maintain the alignment of pawls 846 and 848 within their respective slots 28 in lever pieces 802 and 804.

Figure 5A:
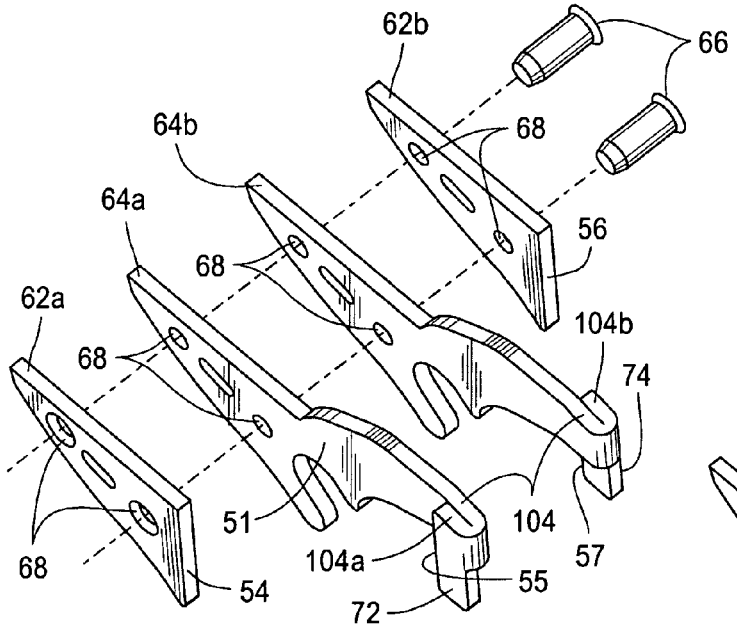
FIG. 5A is an exploded perspective view of the laminated sliding jaw member of the tool shown in FIG. 1.
Figure 5B:
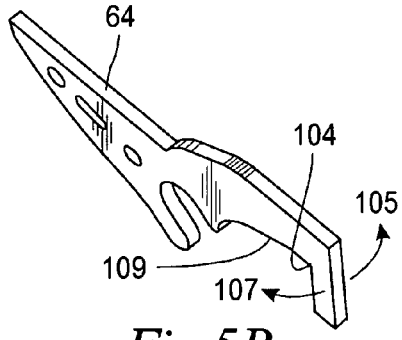
FIG. 5B shows an inner jaw piece for the sliding jaw member shown in FIG. 5A, prior to forming a guide on the inner jaw piece.

Jaw member 22 is movably confined by lever 14 so as to oppose fixed jaw 16. Jaw 22 is roughly the same size and shape as jaw 16. As is shown in FIG. 5A, jaw 22 is formed from a pair of outer pieces 62*a* and 62*b* and a pair of inner pieces 64*a* and 64*b*. Outer pieces 62*a* and 62*b* and inner pieces 64*a* and 64*b* are all joined together using two rivets 66 through holes 68. As can be seen best in FIG. 5A, piece 64*a* defines a guide 72, and piece 64*b* defines a guide 74. Guides 72 and 74 are positioned on opposite sides of section 44 of lever 12 so as to help stabilize jaw 22 yet clear lever 12. FIG. 5B shows an inner piece 64, which could be the precursor for either of inner pieces 64*a* or 64*b*, prior to the formation of a guide 72 or 74 on piece 64*a* or 64*b*. Piece 64 defines an extension 104, which is subsequently folded over section 109 in direction 105 to form a guide 74 for inner piece 64*a*, and in direction 107 to form a guide 72 for inner piece 64*b*.

Figure 3A:
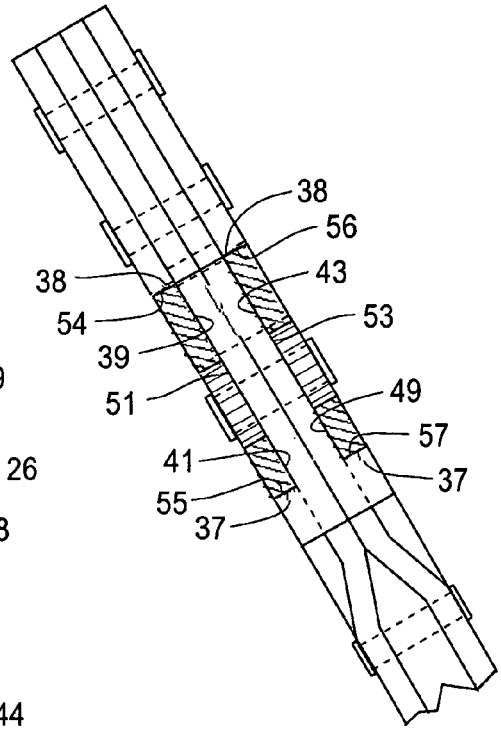
FIG. 3A is a sectional view of the tool shown in FIG. 3 taken along the line IIIA-IIIA.
Figure 4:
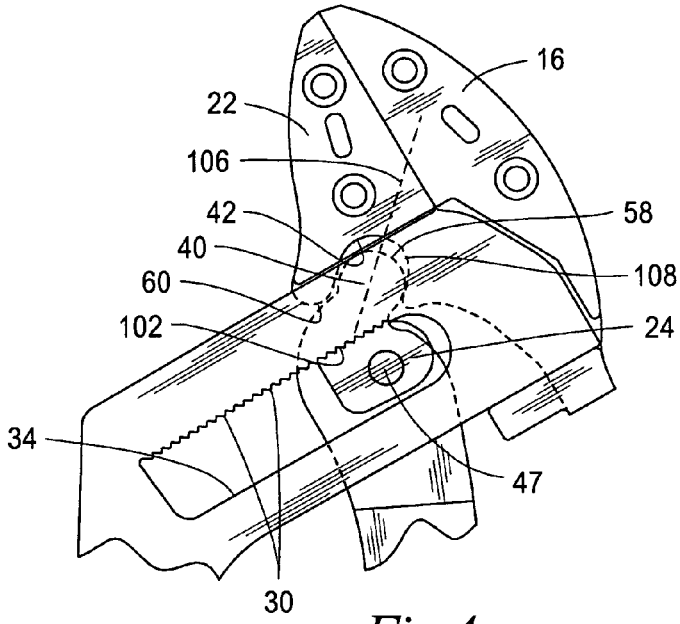
FIG. 4 is a fragmentary side elevation view of the upper end of the tool shown in FIG. 1, with the jaws in the fully closed position.

As is shown in detail in FIG. 5A, outer piece 62*a* of jaw 22 defines a flat bearing surface 54, outer piece 62*b* defines a flat bearing surface 56, extension 104*a* of piece 64*a* defines a flat bearing surface 55, and extension 104*b* of piece 64*b* defines a flat bearing surface 57. Referring to FIGS. 2 and 3A, it can be visualized that as jaw 22 is moved toward and away from jaw 16, surface 56 slides along bearing surface 38 of piece 804, surface 54 slides along bearing surface 38 of piece 802, surface 55 slides along bearing surface 37 of piece 802, and surface 57 slides along bearing surface 37 of piece 804. Referring now to FIGS. 2, 3A, and 5A, it can be appreciated that inner piece 64*a* also defines a flat bearing surface 51 and inner piece 64*b* defines a flat bearing surface 53. Bearing surface 51 slides along bearing surfaces 39 and 41 of lever 14 and bearing surface 53 slides along bearing surfaces 43 and 49 of lever 14 as jaw 22 is moved toward and away from jaw 16. Accordingly, bearing surfaces 37, 38, 39, 41, 43, and 49 of lever 14 define a linear path of travel for jaw 22 toward and away from jaw 16. Specifically, surface 54 of jaw 22 is guided by bearing surface 38 of piece 802, surface 56 of jaw 22 is guided by bearing surface 38 of piece 804, surface 57 of jaw 22 is guided by bearing surface 37 of piece 804 and surface 55 of jaw 22 is guided by bearing surface 37 of piece 802, while surface 51 of jaw 22 is guided by bearing surfaces 39 and 41 of piece 802 and surface 53 of jaw 22 is guided by bearing surfaces 43 and 49 of piece 804. Sufficient clearance is provided between surfaces 54, 55, 56, 57, 51, and 53, and surfaces 37, 38, 39, 41, 43, and 49 to permit sliding jaw 22 to travel a closely controlled path along those surfaces. Surfaces 54, 55, 56, 57, 51 and 53, and surfaces 37, 38, 39, 41, 43, and 49 are so configured that gripping surfaces 18 and 19 confront and remain parallel to each other as jaw 22 moves toward and away from jaw 16.

Jaw 22 defines slot 42 (see FIG. 3), which has a closed end 58 and an open end 60 for receiving the nose end of lever 12. The closed end 58 of slot 42 is nearer the gripping surface 18 of jaw 16 than is the open end or entrance 60 of slot 42. Slot 42 is angled upward toward fixed jaw 16 from open end 60 of slot 42 to closed end 58, as is evident in FIG. 4 from the position of the longitudinal axis 106 of slot 42.

Referring to FIGS. 2 and 3, biasing lever 20 is operatively connected to levers 12 and 14. End 76 of biasing lever 20 is located within channel 82 defined by pieces 802 and 827. End 76 engages a spring load from end 78 of compression spring 80 that is positioned in channel 82. End 84 of spring 80 is constrained by the bottom 86 of channel 82. The other end 88 of biasing lever 20 is rotatably connected to lever 12 by a shaft 89 that is fixed in hole 856 defined by piece 824 and hole 858 defined by piece 826. End 90 of a tension spring 92 is attached to end 88 by looping end 90 through hole 94 formed in end 88. Spring 92 is located in a channel 100 which is formed in lever 12. The remaining end 96 of spring 92 is attached to hole 98 formed in piece 828.

Lever 12 interacts with jaw 22, biasing lever 20 and lever 14 as tool 10 is operated by a user. The interaction between lever 12 and lever 14 is controlled by biasing lever 20. Spring 92 acts through biasing lever 20 to provide a force to spread apart handle sections 36 and 48 and jaws 16 and 22 to the open position of tool 10.

Referring to FIGS. 2 and 3, each pawl 846 and 848 has a planar web, a rounded end opposing a flat end and a toothed edge opposing a smooth edge. The toothed edge 50 of each pawl 846 and 848 defines a linear array of teeth 102 of the same shape and pitch as teeth 30 of edge 32 of the corresponding slot 28. The smooth edge 52 of each pawl 846 and 848 is straight, smooth, and opposes the corresponding toothed edge 50 of pawl 846 or 848. Each pawl 846 and 848 is coplanar with a slot 28. Each pawl 846 and 848 is sized so that there is no contact between its toothed edge 50 and the teeth of the edge 32 of the corresponding slot 28 when the smooth edges 52 pawls 846 and 848 are biased against the smooth edge 34 of the corresponding slot 28.

Referring to FIG. 3, it may be appreciated that until tool 10 comes under load, rivet 89 near end 88 of biasing lever 20 constitutes a fulcrum around which force is applied to move jaws 16 and 22 toward one another as the user squeezes the handle sections 36 and 48 together. When a load is removed from tool 10, spring 92 pulls end 88 of biasing lever 20 toward handle section 48, causing biasing lever 20 to rotate clockwise around rivet 89. This rotation causes handle section 48 to move to its maximum distance away from handle section 36 of lever 14. This rotation also causes toothed edge 50 of pawl assembly 24 to disengage from toothed edge 32 of slot 38, and urges the smooth edges 52 of the paw assembly 24 against the corresponding smooth edges 34 of slot 38. The disengagement makes jaw 22 free to slide along guide surfaces 37, 38, 39, 41, 43, and 49 toward and away from jaw 16.

When tool 10 is in the unloaded, open position, circular end 40 of lever 12 is positioned in the entrance 60 of slot 42, as shown in FIG. 3. When the user squeezes the handle sections 36 and 48 to begin moving the jaws 16 and 22 toward each other, lever 12 begins to rotate in the clockwise direction around rivet 89. This rotation causes circular end 40 of lever 12 to begin to rotate in slot 42 toward jaw 16 and jaw 22 to begin to move along surface 38. It also causes pawl assembly 24 to begin to move along edge 52 toward jaw 16. As further load is applied to the tool 10, the circular end 40 travels in a complex, generally arcuate path that is defined by the pivoting movement of lever 12 around rivet 89 and the linear travel of the pawl assembly 24 in slot 28. The size and shape of slot 42 and the orientation of its longitudinal axis 106 are adapted to permit circular end 40 to travel this complex path, while still permitting close control of the linear movement of the jaw 22 without binding or restriction.

Tool 10 first comes under load when gripping surfaces 18 and 19 first engage a workpiece positioned between jaws 22 and 16. As the user increases the force to applied to handle sections 36 and 48, circular end 40 rotates deeper into the slot 42 and handle section 36 continues to move toward handle section 48. Because the pawl assembly 24 is pivotally connected to the lever 12, the movement of handle section 36 causes pawl assembly 24 to be moved from the smooth edge 34 to the toothed edge 32 of slot 28. The teeth 102 of the pawl assembly 24 engage the teeth of edge 32. When this engagement occurs, the active fulcrum of tool 10 is transferred from rivet 89 of the biasing lever 20 to pin 47, which connects pawl assembly 24 to lever 12. A further increase in the force applied to handle sections 36 and 48 causes lever 12 to urge jaw 22 into leveraged engagement with the workpiece. Surprisingly, the relatively short distance from the active fulcrum, i.e., pawl pin 47, to the contact point between surface 108 and circular end 40 compared to the distance from the active fulcrum to the effective point of force application by operator's hand on handle section 48, provides for much greater leverage than is normally achieved by simple pivoted pliers. For the embodiment of the present invention currently under discussion, the increase in leverage is about three times as much as would be achieved by simple pivoted pliers. When the user's hand releases handle sections 36 and 48, the tool 10 becomes unloaded and the biasing lever 20 acts to return the pawl assembly 24 to the smooth side 52 of the slot 28 and to move the jaws 16 and 22 away from one another toward the fully open position.

FIGS. 6 and 13 through 15 show tools 200, 400, and 500 according to embodiments of the present invention that are identical to tool 10 with the exception that their jaws 206, 208, 402, 404, 502, and 504 are of solid, rather than laminated, construction.

Figure 6:
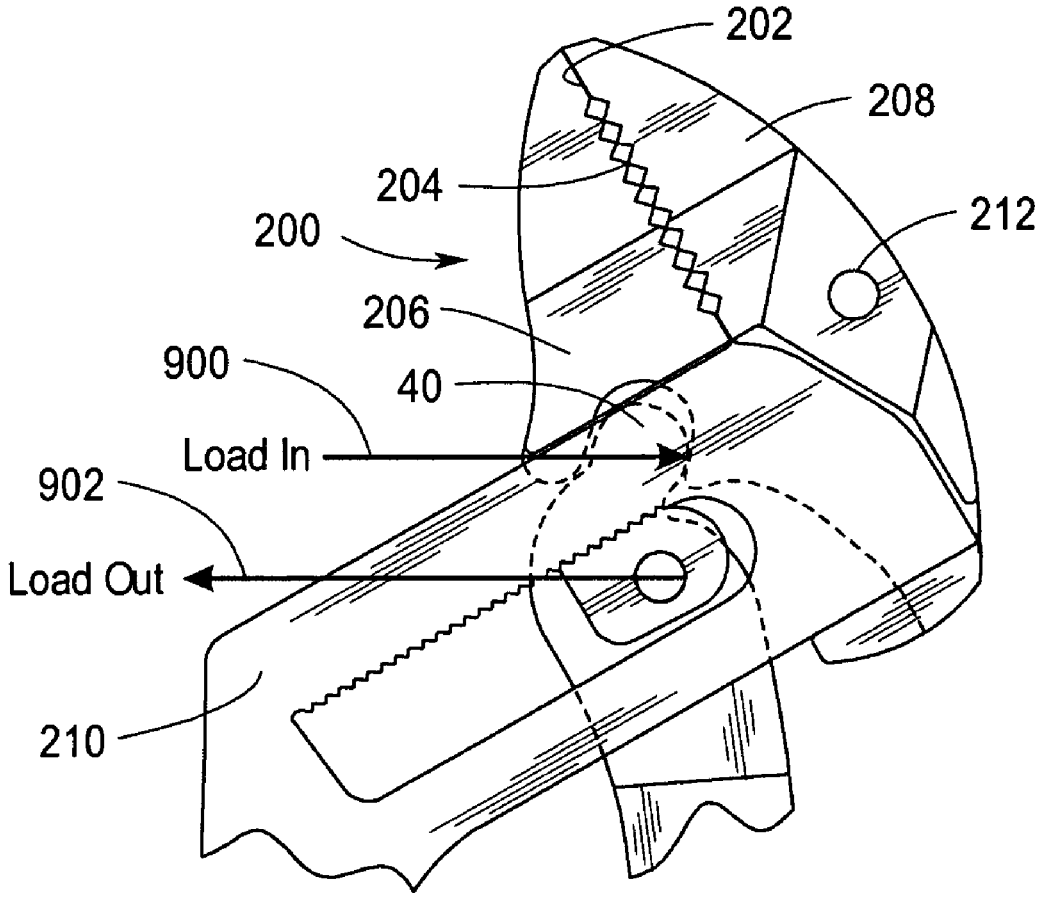
FIG. 6 is a fragmentary side elevation view of the upper end of a tool that is identical to the tool shown in FIG. 1, but that has solid jaws that define differently configured gripping surfaces.

FIG. 6 illustrates the direction of loads applied by the pivot lever through the engaged pawl assembly for the tools shown in the drawings. In FIG. 6, arrow 900 shows the general direction of the force applied to the slot 42 by circular end 40, and arrow 902 shows the general direction of the force that moves through pawl assembly 24 into the teeth of toothed slot 28 as the handle sections 48 and 36 are squeezed when tool 200 is under load.

Figure 7:
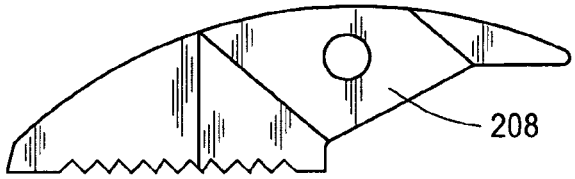
FIG. 7 is a side elevation view of the fixed solid jaw of the tool shown in FIG. 6.
Figure 9:
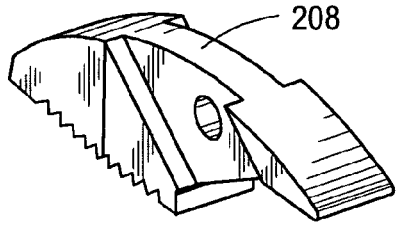
FIG. 9 is a perspective view of the solid jaw shown in FIG. 7.
Figure 8:
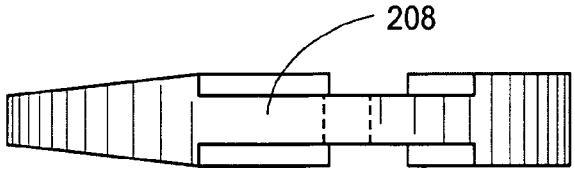
FIG. 8 is a top plan view of the solid jaw shown in FIG. 7.
Figure 10:
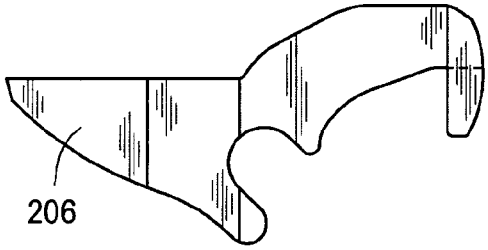
FIG. 10 is a side elevation view of the solid movable jaw member shown in FIG. 6.
Figure 12:
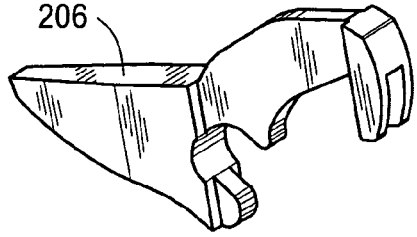
FIG. 12 is a perspective view of the solid jaw member shown in FIG. 10.
Figure 11:
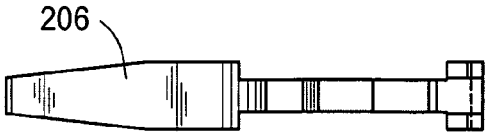
FIG. 11 is a top plan view of the solid jaw member shown in FIG. 10.

FIGS. 7, 8, and 9 show the solid fixed jaw 208, which is secured to fixed lever 210 using a rivet 212. FIGS. 10, 11, and 12 show solid sliding jaw 206 without teeth.

FIG. 13 shows a tool 400 which has solid jaws 402 and 404 configured to provide a needle-nosed tool.

FIG. 15 shows a tool 500 which has solid jaws 502 and 504. Gripping surfaces 506 and 508 of tool 500 provide a known self-engaging gripping surface.

FIG. 16 shows a tool 600 having needle nose jaws 602 and 604. This tool is identical to tool 400 shown in FIG. 13, except that jaws 602 and 604 are of laminated, rather than solid, construction.

Figure 17A:
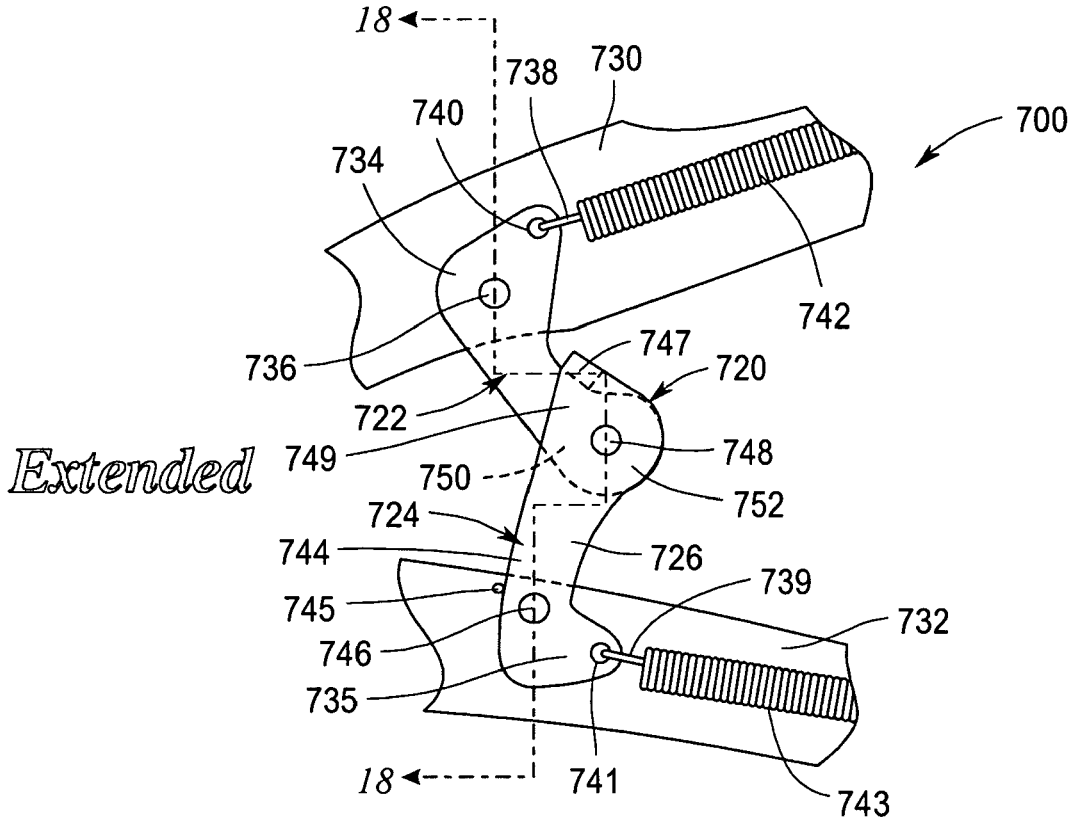
FIG. 17A shows a knee-action biasing lever in the extended position.
Figure 17B:
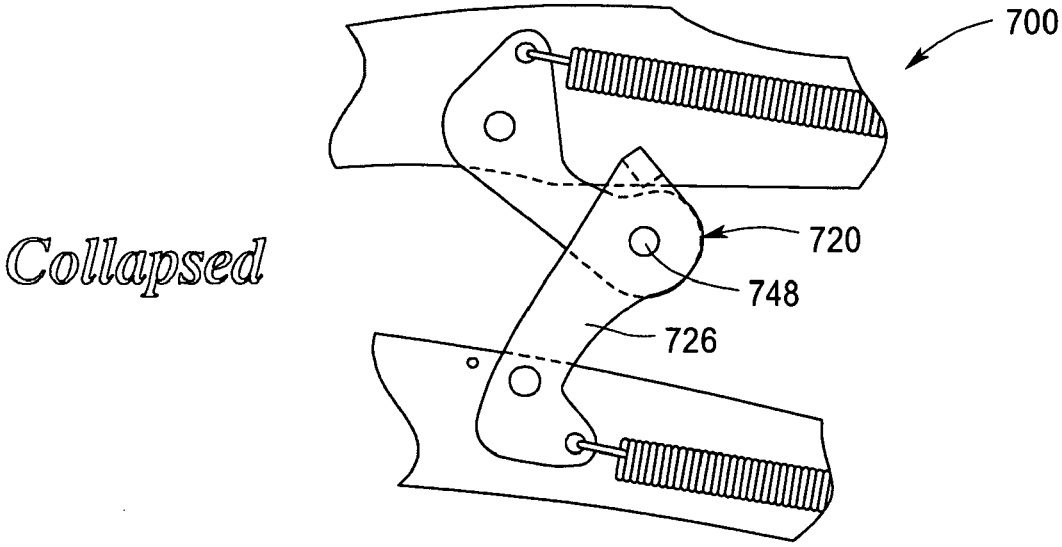
FIG. 17B shows a knee-action biasing lever in the collapsed position.
Figure 18:
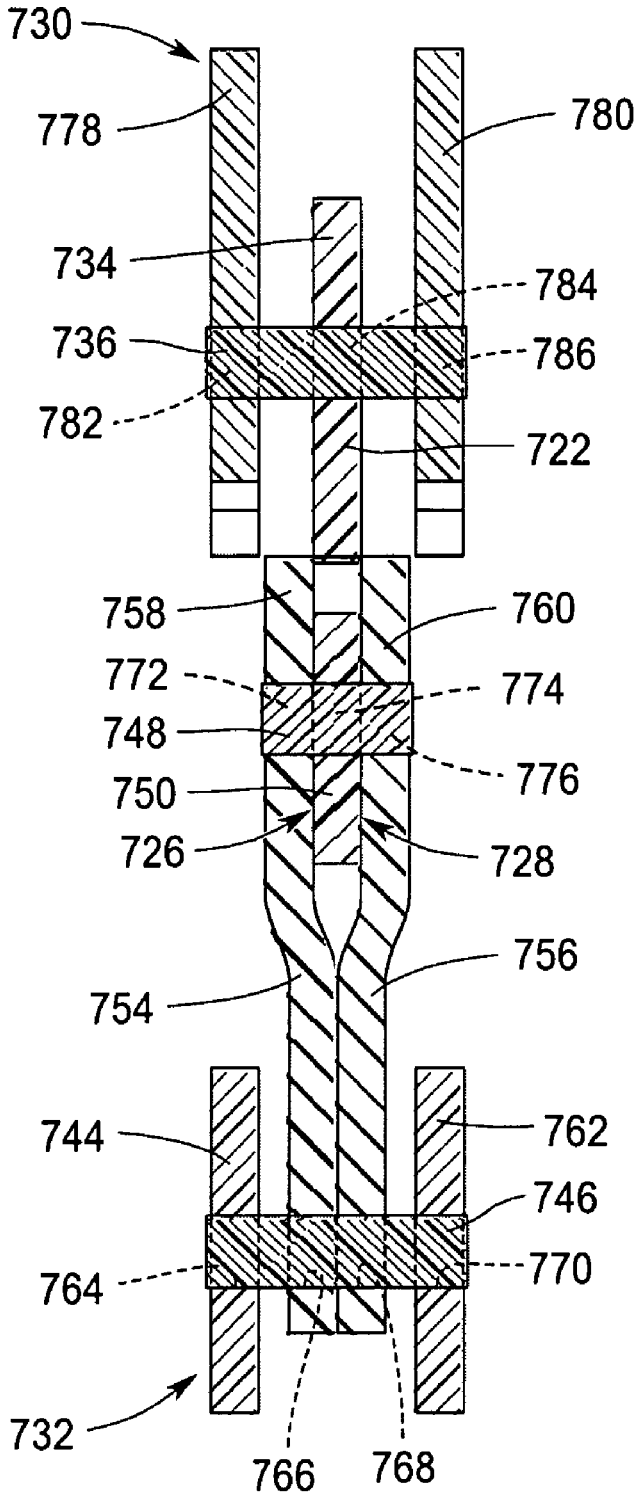
FIG. 18 is a cross-sectional view of the lever shown in FIGS. 17A and 17B, taken along the line 18-18.

FIGS. 17A, 17B, and 18 show a part of a tool 700 according to an embodiment of the present invention that employs a known knee-action biasing lever 720, rather than the one piece biasing lever 20 shown in FIG. 3. Tool 700 is identical in structure and operation to tool 10 shown in FIG. 1, except for the structure and operation of biasing lever 720. Biasing lever 720 is pivotably connected to both pivoting lever 730 and fixed lever 732. Biasing lever 720 includes an upper arm 722 and a lower arm 724.

Upper arm 722 is formed from a single lamination, while lower arm 724 is formed from two laminations 726 and 728. End 734 of upper arm 722 is pivotally secured to pivoting lever 730, by inserting end 734 between laminations 778 and 780 of pivoting lever 730 by aligning hole 782 formed by lamination 778 with hole 784 formed by end 734 and hole 786 formed by lamination 780, and by inserting and securing a rivet 736 therewithin. End 738 of tension spring 742 is looped through hole 740 in end 734 of upper arm 722 to operably connect spring 742 to upper arm 722.

Lower arm 724 is pivotally connected to fixed lever 732. End 739 of tension spring 743 is looped through hole 741 in end 735 of arm 724 to connect spring 743 to arm 724. The remaining ends (not shown) of springs 742 and 743 are suitably mounted to pivoting lever 730 and fixed lever 732, respectively.

When the user applies force to the handle sections of pivoting lever 730 and fixed lever 732 to squeeze them together, knee-action biasing lever 720 remains in its extended position until the pawl teeth engage the teeth of the toothed slot. Thereafter, lower arm 724 rotates in the clockwise direction and upper arm 722 rotates in the counterclockwise direction around connection 748, and springs 742 and 743 are stretched as knee-action biasing lever 720 moves from its extended position shown in FIG. 17A toward its collapsed position shown in FIG. 17B. When the user removes the force applied to the handle sections of pivoting lever 730 and fixed lever 732, springs 742 and 743 return to their relaxed conditions, which is shown in FIG. 17A. As spring 742 returns to its relaxed condition, it rotates upper arm 722 in the clockwise direction, and as spring 743 returns to its relaxed condition, it rotates lower arm 724 in the counterclockwise direction toward the position shown in FIG. 17A. A pin 745 is connected to fixed lever 732 and stop 747 is formed on end 749 of lower arm 724. Pin 745 and stop 747 operate to limit the counterclockwise rotation of lower arm 724 with respect to arm 722 and, consequently, the separation of the handle sections of pivoting lever 730 and fixed lever 732 when tool 700 is in the open position.

Lamination 726 defines a flat mounting section 754 and lamination 728 forms a second flat mounting section 756. Mounting sections 754 and 756 abut each other when lower arm 724 is assembled and connected to fixed lever 732. Mounting sections 754 and 756 are pivotally connected to fixed lever 732 by inserting mounting sections 754 and 756 between laminations 744 and 762 of fixed lever 732, and then aligning hole 764 formed in lamination 744 with hole 766 formed in mounting section 754 and hole 768 formed in mounting section 756 and hole 770 formed in lamination 762, and then inserting and securing rivet 746 therewithin.

Also, lamination 726 forms a mounting section 758 and lamination 728 forms a mounting section 760. Mounting sections 758 and 760 are spaced apart from each other to receive end 750 of upper arm 722 when lower arm 724 is assembled and connected to fixed lever 732. Mounting sections 758 and 760 are pivotally connected to end 750 of upper arm 722 by inserting end 750 between mounting sections 758 and 760, and then aligning hole 772 formed in mounting section 758 with hole 774 formed in end 750 and hole 776 formed in mounting section 760, and then inserting and securing rivet 748 therewithin to form a spring-loaded connection.

The spring-loaded connection biases tool 700 to its open position and the knee-action biasing lever 720 to its extended position as shown in FIG. 17A. Knee-action biasing lever 720 implements the self-adjusting feature of tool 700 in a similar manner to that which is explained above with respect to tool 10. However, the spring-loaded connection of the knee-action biasing lever eliminates the need for an end of the biasing lever to slide within a channel in the fixed lever of the tool as was the case for the biasing lever described for tool 10 with regard to FIGS. 1-3. Instead, biasing lever 720 collapses at the spring-loaded connection when the handle sections of pivoting lever 730 and fixed lever 732 are squeezed together by the user, as described above. This collapse permits the handle section of pivoting lever 730 to close toward the handle section of fixed lever 732.

Figure 19:
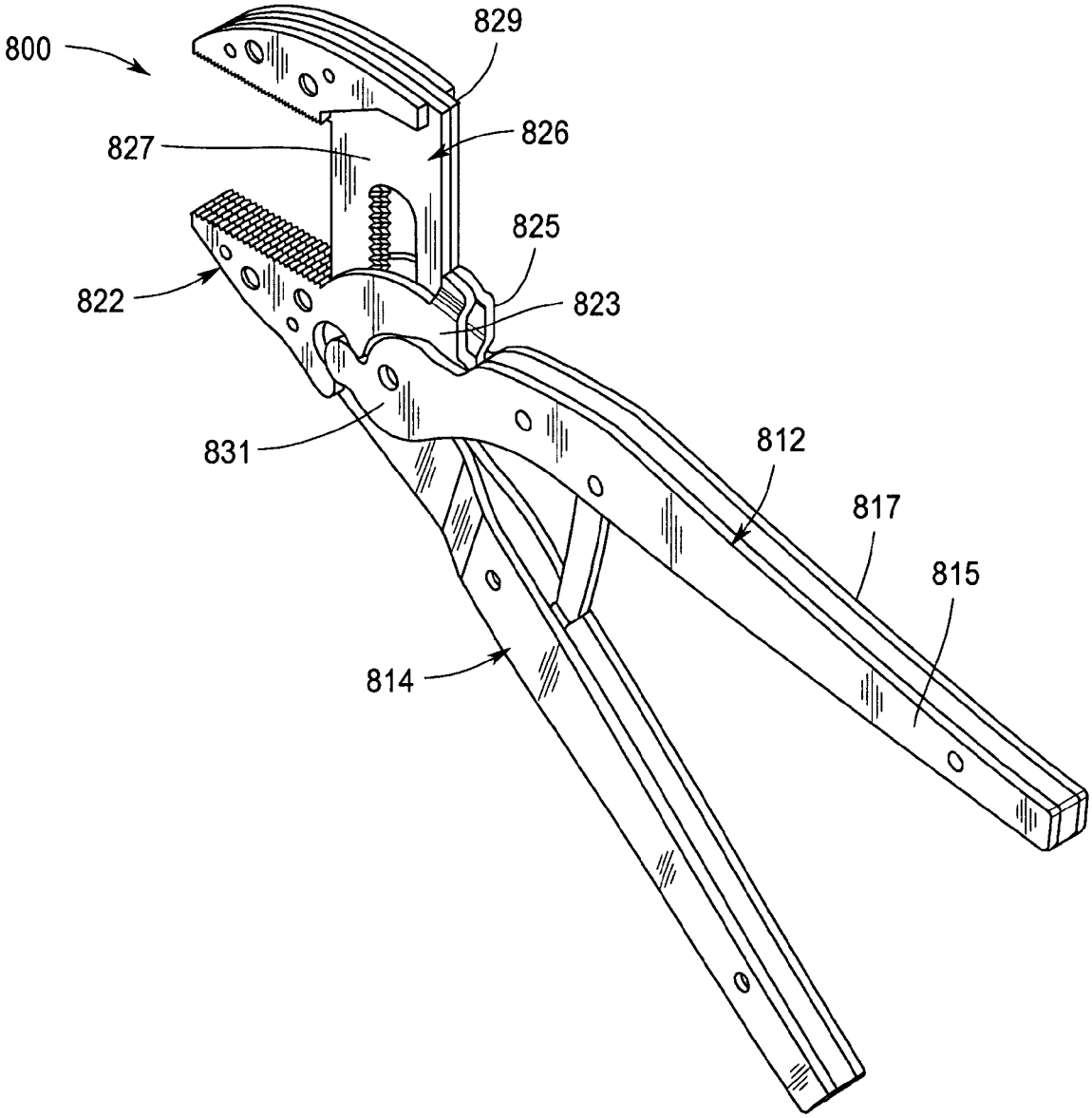
FIG. 19 is a perspective view of another embodiment of the present invention that has a "reverse" laminated construction, shown in the open position.

FIG. 19 shows a further embodiment 800 of the present invention, which has a "reverse" laminated construction. Tool 800 is similar in its operation to tool 10 shown in FIG. 1. For tool 10, the pivoting lever 12 and the sliding jaw 22 are confined within laminate pieces 802 and 804 of the fixed lever 14. In contrast, the pivoting lever 812 of tool 800 includes spaced apart laminations 815 and 817, and the sliding jaw 822 of tool 800 includes spaced apart laminations 823 and 825 which encompass a portion of the intermediate section 826 of the fixed lever 814. Unlike fixed lever 14 of tool 10, intermediate section 826 of the fixed lever 814 is not formed by spaced apart laminations, but rather by laminations 827 and 829 that abut each other. Moreover, for tool 800, intermediate section 826 of the fixed lever 814 is located between pieces 815 and 817 of the pivoting lever 812, and between pieces 823 and 825 of the sliding jaw 822. Further, the pawl assembly (not visible in FIG. 19) of tool 800 is disposed within the intermediate section 831 of the pivoting lever 812 between the two laminations 815 and 817.

Additional changes may be made to the design of the invention. These variations should not be considered as a departure from the subject invention.

Whereas particular embodiments of the present invention have been described above for purposes of illustration, it will be evident to those skilled in the art the numerous variations of the details of the present invention may be made without departing from the invention as defined in the appended claims.

What is claimed is:

1. A self-adjusting tool with parallel jaws for gripping a workpiece, said tool comprising:

a) a first lever having a handle section, an intermediate section, and a first jaw, said first intermediate section having two parallel bearing surfaces and a longitudinally extending slot, said slot having a toothed surface and a smooth surface arranged in opposition to one another, and said first jaw having a first workpiece bearing surface;

b) a second lever having a handle section, an intermediate section, and a nose end;

c) a second jaw having a second workpiece bearing surface and a nose end receiving slot adapted for receiving said second lever nose end, said nose end receiving slot having a longitudinal axis, said longitudinal axis being disposed at an angle to said smooth surface of said first lever slot, and said second jaw being movably confined by said two parallel bearing surfaces;

d) a pawl having a toothed surface and a smooth surface, said pawl being movably situated within said first lever slot;

e) a first connection between said pawl and said second lever, said first connection rotatably connecting said pawl and said second lever;

f) a third lever having a first and a second end, said first end being operatively connected to said first lever; and g) a second connection operatively connecting said third lever second end to said second lever;

wherein when a workpiece is interposed between said first and second jaws and opposing forces are applied to said first lever handle section and said second lever handle section to move them toward one another, said second lever initially rotates about said second connection causing said second jaw to move along said first and second bearing surfaces in the direction of said first jaw until movement of said second jaw is restricted by said workpiece, the movement restriction of said second jaw permitting said opposing forces to cause said second lever nose end to travel within said nose end receiving slot of said second jaw thereby moving said toothed surface of said pawl into locking engagement with said toothed surface of said first lever slot so that further application of said opposing forces causes said second lever to rotate about said first connection and said opposing forces to be transmitted through said first and second workpiece bearing surfaces to said workpiece, said first and second workpiece bearing surfaces being substantially parallel to one another during said transmission of said opposing forces.

2. The tool of claim 1, wherein said angle between said longitudinal axis of said slot of said second jaw and said smooth surface of said first lever first slot is in the range of about 30 degrees to less than 90 degrees.

3. The tool of claim 2, wherein said angle is about 45 degrees.

4. The tool of claim 1, wherein at least one of said first and second jaws is of laminated construction.

5. The tool of claim 1, wherein at least one of said first and second levers is of laminated construction.

6. The tool of claim 1, wherein at least one of said first and second jaws is a needle nose jaw.

7. The tool of claim 1, wherein at least one of said first and second workpiece bearing surfaces has a self-engaging gripping surface design.

8. The tool of claim 1, wherein at least one of said first and second workpiece bearing surfaces is smooth.

9. The tool of claim 1, wherein at least one of said first and second workpiece bearing surfaces is toothed.

10. The tool of claim 1, wherein said third lever comprises a knee-action lever.

11. The tool of claim 1, wherein at least one of said first lever handle section and said second lever handle section is curved.

12. The tool of claim 1, further comprising a spring, said spring being disposed within a channel, said channel being disposed within said first lever handle section, wherein said spring is in operative contact with a first end of said third lever so as to urge said third lever first end toward said first jaw.

13. The tool of claim 1, wherein at least one of said second lever nose end and said contact surface of said slot of said second jaw has an arcuate shape.

14. The tool of claim 1, wherein said toothed surface and said smooth surface of said pawl are parallel to each other.

15. The tool of claim 1, wherein said toothed surface and said smooth surface of said first lever slot are not parallel to one another.

16. The tool of claim 1, wherein said tool has a reverse laminate construction.

17. A method of using the tool of claim 1, said method comprising the step of gripping a workpiece between said first and second workpiece bearing surfaces of said tool.

18. The method of claim 17, wherein said workpiece has two co-parallel planar surfaces and said step of gripping includes said first workpiece bearing surface of said tool contacting one of said workpiece planar surfaces and said second workpiece bearing surface of said tool contacting the other of said workpiece planar surfaces.

19. The method of claim 17, wherein said workpiece has a cylindrical section and said step of gripping comprises gripping said cylindrical section between said first and second workpiece bearing surfaces of said tool.

20. The method of claim 17, wherein said workpiece is one selected from the group consisting of a plate and a bar.

* * * * *